US005255449A

United States Patent [19]

Nakamura et al.

[11] Patent Number: 5,255,449

[45] Date of Patent: Oct. 26, 1993

[54] CLOTH DRYER

[75] Inventors: Yoshizo Nakamura; Matashige Kanzaki, both of Takamatsu, Japan

[73] Assignee: Tokai Co., Ltd., Japan

[21] Appl. No.: 951,826

[22] Filed: Sep. 28, 1992

[30] Foreign Application Priority Data

Nov. 8, 1991 [JP] Japan ..... 3-293408

[51] Int. Cl.[5] ..... F26B 11/04

[52] U.S. Cl. ..... 34/133 H; 34/133 Q

[58] Field of Search ..... 34/130, 131, 133 R, 34/133 G, 133 H, 133 Q

[56] References Cited

U.S. PATENT DOCUMENTS 1,763,462 6/1930 Gabre ..... 34/130 X 2,960,778 11/1960 Cowlin ..... 34/130

FOREIGN PATENT DOCUMENTS 1585890 10/1967 Fed. Rep. of Germany .

1263729 8/1960 France .

*Primary Examiner*—Henry A. Bennet

*Attorney, Agent, or Firm*—Lorusso & Loud

[57] ABSTRACT

A cloth dryer includes a rotary cylindrical drum defining therewithin a drying chamber for cloths, an air blower for feeding air to the drying chamber for drying the cloths, an opening formed in an outer periphery of the drum for discharging the cloths from the drying chamber therethrough, a cover plate supported on the drum and movable relative to said drum to open and close the opening, whereby the cloths within the drying chamber are discharged by gravity therefrom through the opening when the drum is stopped to maintain the opening in a downwardly oriented position and when the cover plate is opened.

15 Claims, 6 Drawing Sheets

CLOTH DRYER

This invention relates to a relatively large sized, cloth dryer utilized in laundry shops.

Because of the necessity to treat a large number of cloths, laundry shops use a relatively large sized, cloth dryer. One known such a dryer includes a rotary drum having an axis disposed in a horizontal position and defining a drying chamber therewithin. Cloths are manually charged in the chamber through an aperture formed in one of the opposite sides the drum. While feeding air into the chamber, the drum is rotated so that the cloths are dried. The dried cloths are then manually discharged from the aperture. In this case, since the cloths are apt to be entwined together during drying, it is not easy to take the cloths out of the drum.

The present invention has been made with the above problem of the known drying apparatus in view. In accordance with the present invention there is provided a cloth dryer comprising:

a frame;

a cylindrical drum defining therewithin a drying chamber for cloths and rotatably supported by said frame with the center axis thereof being disposed in a horizontal position and serving as a center of rotation;

means for rotating said drum about said center axis;

an opening formed in an outer periphery of said drum for discharging the cloths from said drying chamber therethrough;

a cover plate supported on said drum and movable relative to said drum between first and second relative positions so that said opening is closed when said cover plate is positioned in said first relative position and is opened when said cover plate is positioned in said second relative position, whereby the cloths within said drying chamber are discharged by gravity therefrom through said opening when said drum is stopped to maintain said opening in a downwardly oriented position and when said cover plate is located in said second relative position; and means disposed adjacent to said drum for blowing air into said drying chamber.

The present invention will now be described in detail below with reference to the accompanying drawings, in which.

Figure 6C:
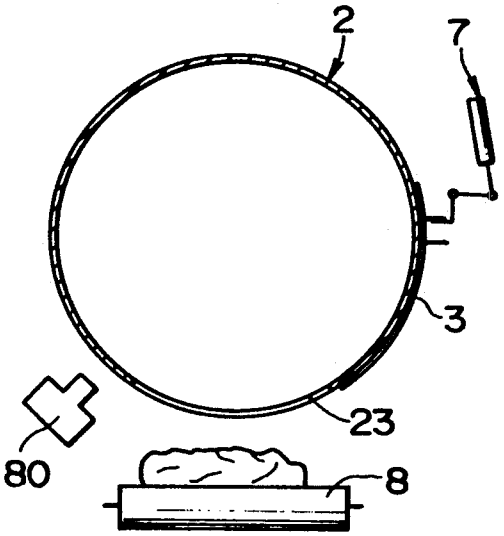
Figure 6B:
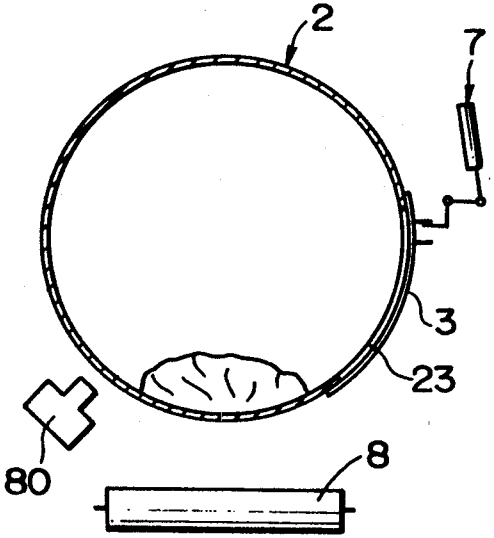
Figure 6A:
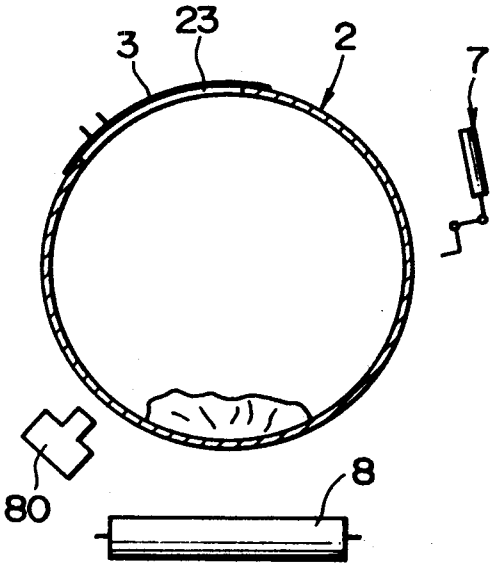

FIGS. 6(*a*) through 6(*c*) are schematic, cross-sectional views of the drum showing the operation of discharging cloths from the drum.

Figure 1:
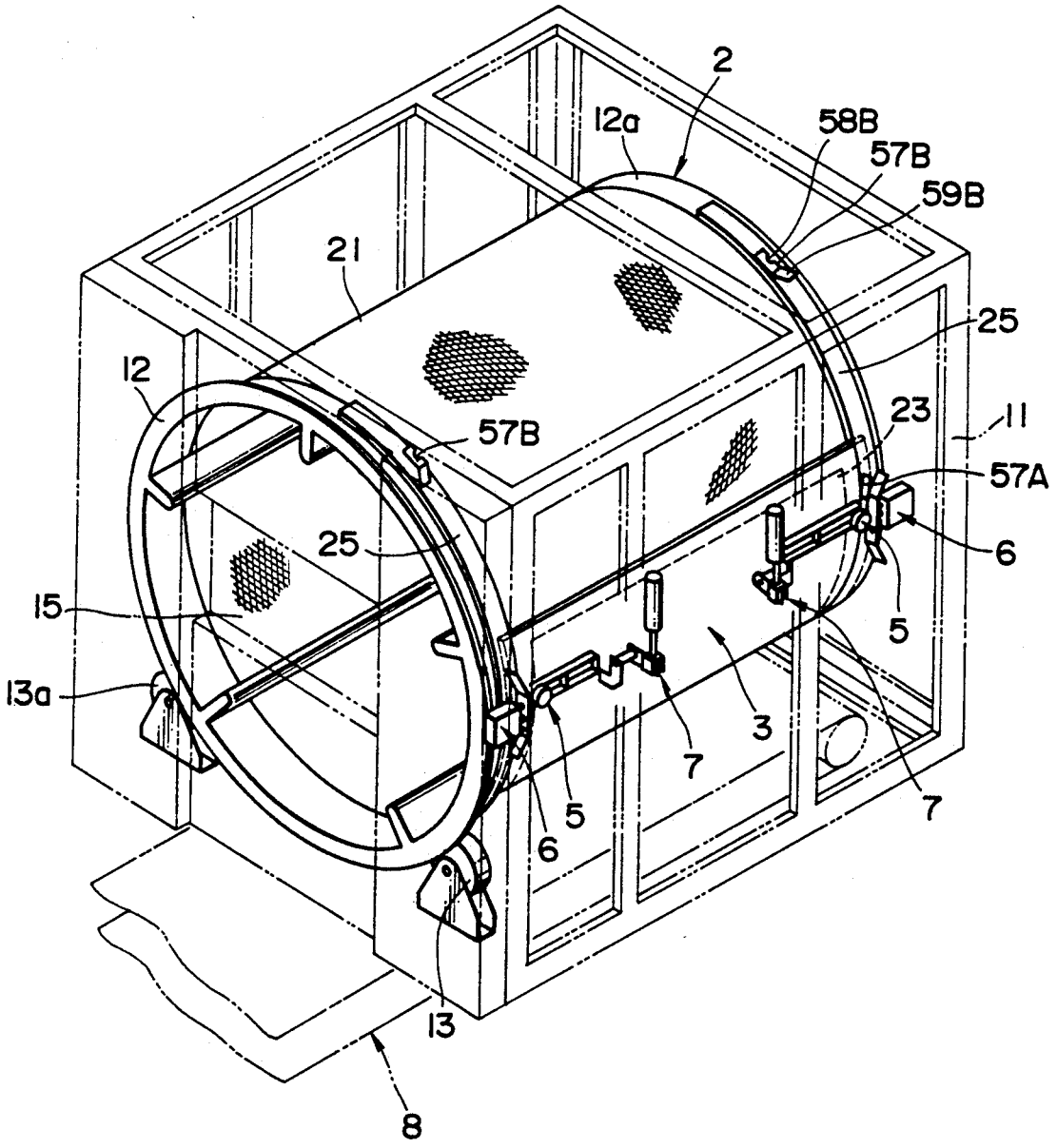
FIG. 1 is a perspective view diagrammatically showing one embodiment of cloth dryer according to the present invention.

Referring now to FIG. 1, the reference numeral 11 denotes a frame to which a cylindrical drum 2 is rotatably mounted in a horizontal position. The drum 2 which defines a cloth drying chamber therewithin is composed of a pair of front and rear rims 12 and 12*a* and a tubular body 21 extending between the front and rear rims 12 and 12*a* and having a multiplicity of perforations. The body 21 in this embodiment is formed of a reinforced metal net. The drum 2 is open at the front end 15 thereof and is closed at the rear end.

Means 80 is disposed (FIG. 6) adjacent to the drum 2 for blowing air into the drying chamber to facilitate the drying of cloths contained therein. The air blowing means 80 in the illustrated embodiment is arranged to blow air, preferably hot air, into the drying chamber through the perforations of the drum 2.

Figure 5:
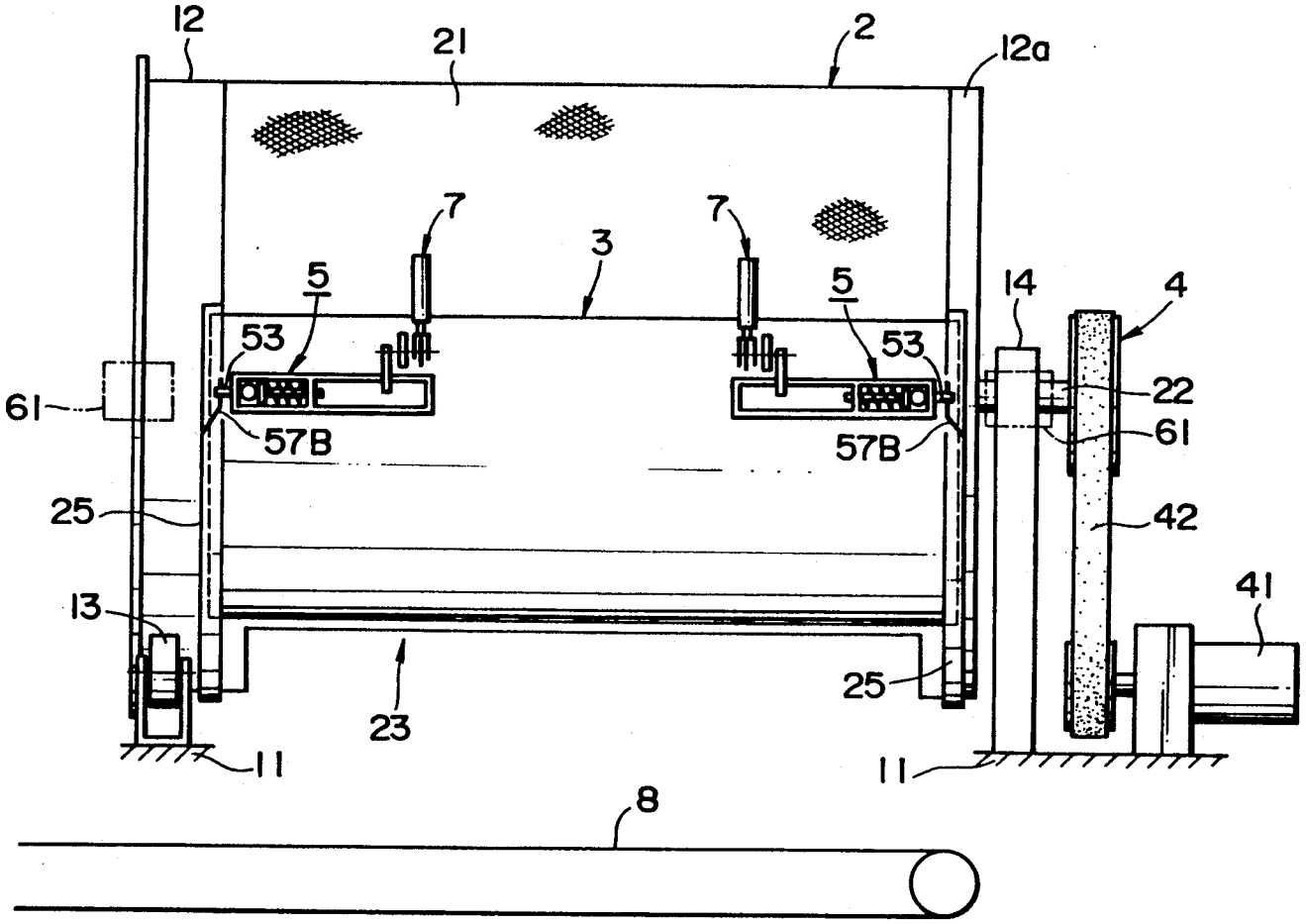
FIG. 5 is an elevational view of the drum of FIG. 1.

A pair of rollers 13 and 13*a* are fixed to the frame 11 for rolling and supporting engagement with the front rim 12 of the drum 2. As shown in FIG. 5, the drum 2 has a shaft 22 protruded outward from the rear end of the drum 2 and received by a bearing 14 secured to the frame 11. Drive means 4 including a motor and a belt 42 is operatively connected to the shaft 22 to rotate the drum 2 about the shaft 22.

An opening 23 is formed in the body 21 of the drum 2 and is used for discharging the cloths from the drying chamber therethrough. The opening 23 has a size large enough to discharge all at once, by gravity, the cloths contained in the drum 2 when oriented downward as shown in FIGS. 5 and 6(*c*). In the illustrated case, the opening 23 extends in the axial direction almost throughout the length of the body 21 and in the peripheral direction through an angle of about 60–70 degrees.

Figure 2:
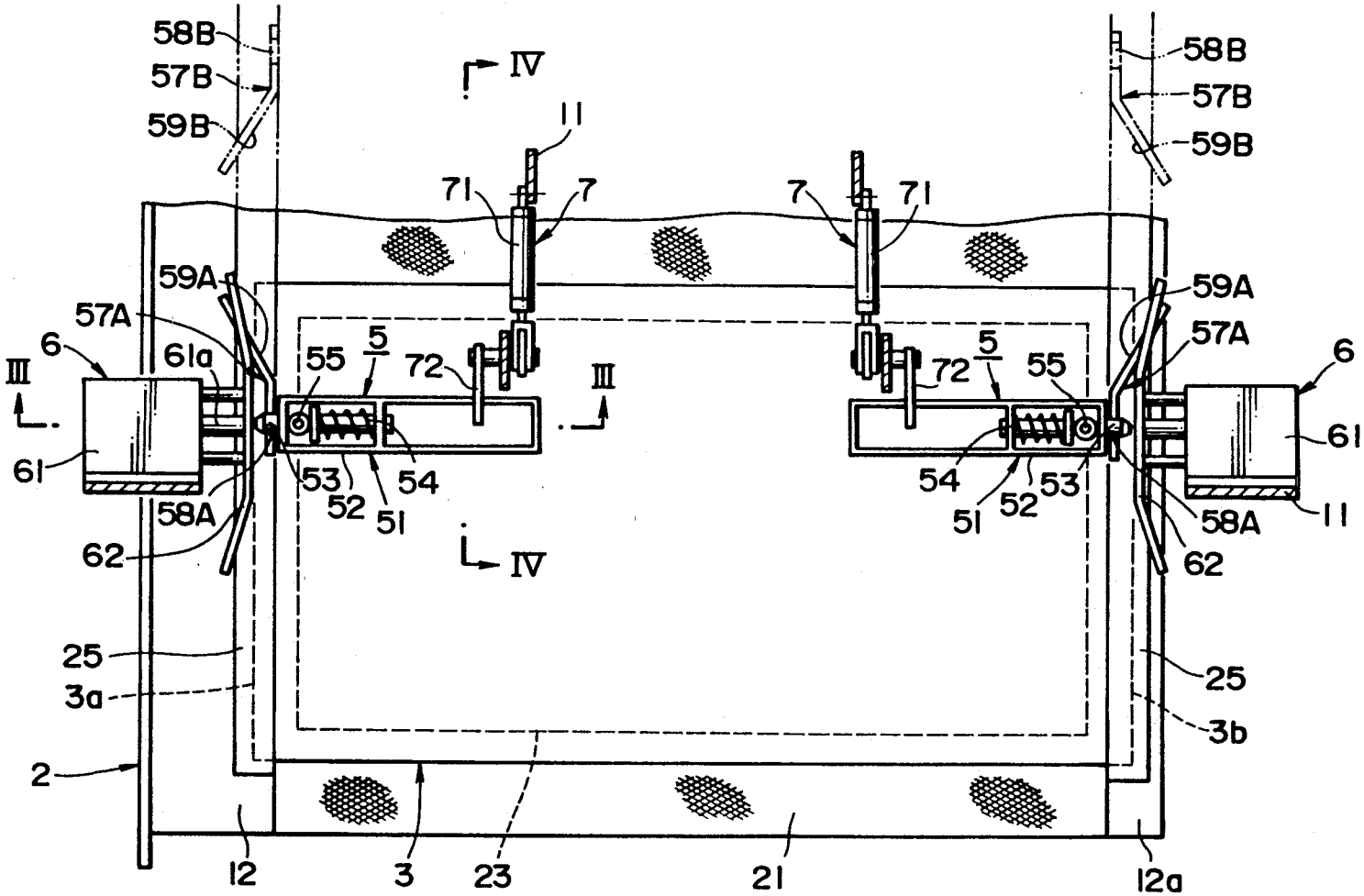
FIG. 2 is a partial, elevational view the dryer of FIG. 1.

A cover plate 3 having a size greater than that of the opening 23 and adapted to close and open the opening 23 is supported on the drum 2. The cover plate 3 in this embodiment is slidable along the cylindrical periphery of the drum 2 in the direction perpendicular to the axis thereof. Thus, a guide plate 25 is fixed to each of the rims 12 and 12*a* to define a groove therebetween. As shown in FIG. 2, the cover plate 3 has end portions 3*a* and 3*b* engaged with respective grooves and, thus, is slidable along the periphery of the drum 2. Thus, the cover plate 3 is movable, relative to the drum 2, between first and second relative positions such that the opening 23 is closed when the cover plate 3 is positioned in the first relative position (FIGS. 1, 2, 4, 6(*a*) and 6(*b*)) and is opened when the cover plate 3 is positioned in the second relative position (FIGS. 5 and 6(*c*)). The opening 23 may be opened and closed by displacing the cover plate 3 while keeping the drum 2 unmoved or by rotating the drum 2 while keeping the cover plate 3 unmoved. The cover plate 3 is desirably provided with a multiplicity of perforations to facilitate the drying of the cloths.

Lock means 5 are mounted on the drum 2 for maintaining the cover plate 3 in the first, close position or the second, open position. While, as shown in FIG. 2, the illustrated embodiment uses a pair of such lock means 5 to ensure the locking operation, only one lock means can achieve the desired object. Since the paired locking means have a similar construction, the explanation of only one locking means will be sufficient.

Figure 3:
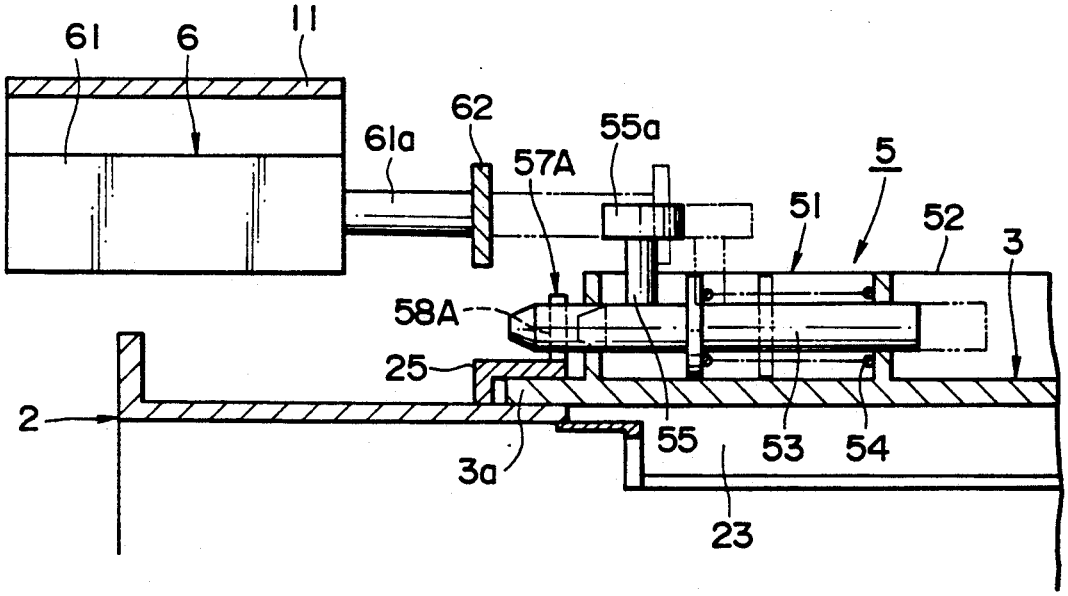
FIG. 3 is a cross-sectional, partial, enlarged view taken on line III—III in FIG. 2.
Figure 4:
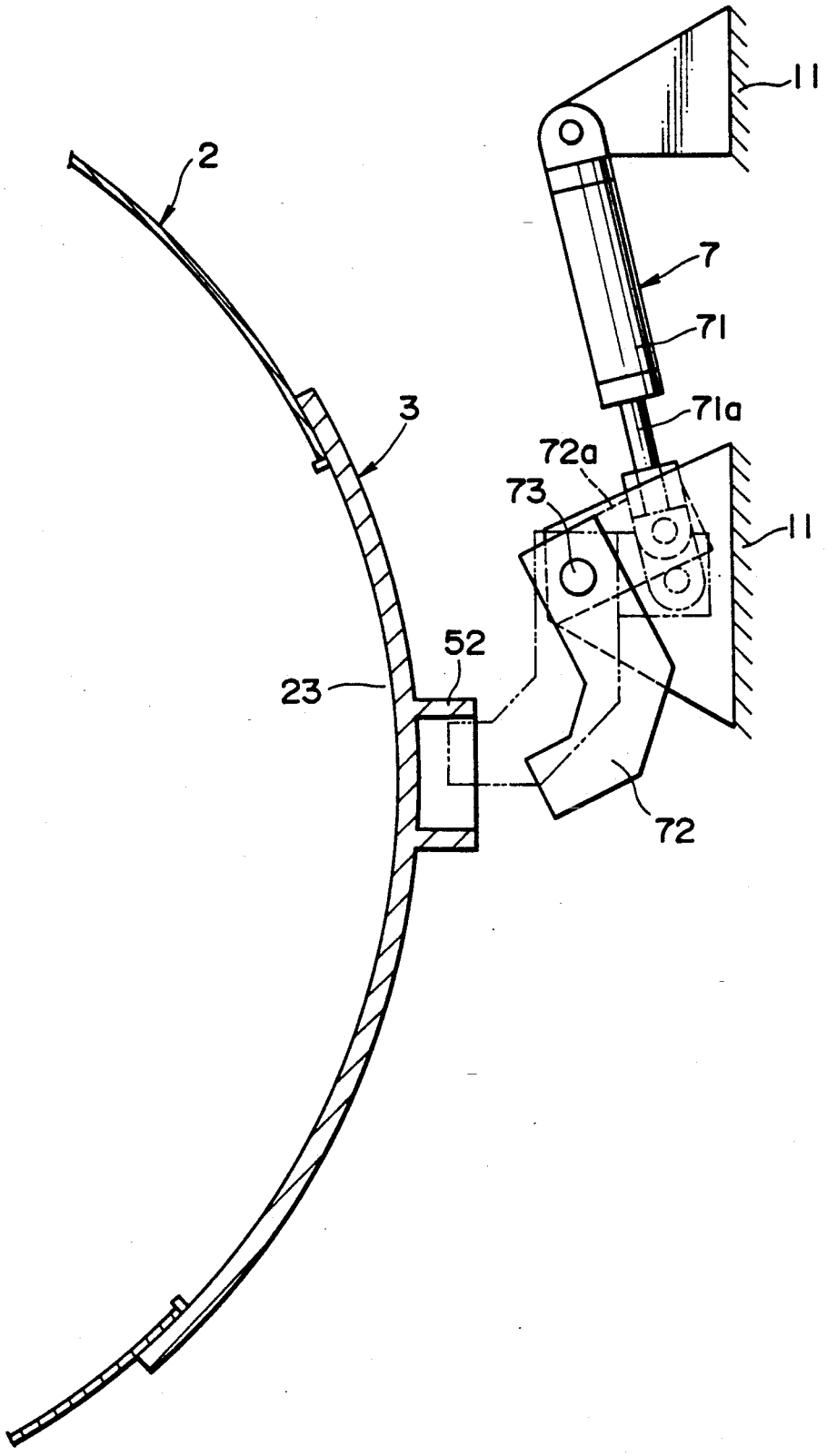
FIG. 4 is a cross-sectional, partial view taken on line IV—IV of FIG. 2.

As shown in FIG. 2, the lock means 5 includes a locking member 51 mounted on the cover plate 3 and a pair of lock receivers 57A and 57B mounted on the guide rail 25. The locking member 51 includes a frame member 52 fixed on the cover plate 3, a slide bar 53 supported by the frame member 52 and movable in the direction parallel with the axis of the drum 2 between a retracted position and an extended position, a spring 54 for normally urging the slide bar 53 toward the extended position, and a pin 55 upwardly extending from the slide bar 53 and having a roller 55*a* at its tip end (FIG. 3).

The lock receiver 57A is in the form of a plate provided with an engaging groove 58A and is fixedly secured on the guide plate 25 at a position so that, when the cover plate 3 is in the first relative position (close position as shown in FIG. 2), the slide bar 53 in the extended position can engage with the engaging groove 58A to prevent the movement of the cover plate 3 relative to the drum 2. The lock receiver 57A has a guide portion 59A which is bent in the axial direction of the drum 2. Similarly, the lock receiver 57B is in the form of a plate provided with an engaging groove 58B and a bent, guide portion 59B and is fixedly secured on the guide plate 25 at a position so that, when the cover plate 3 is in the second relative position (open position as shown in FIG. 5), the slide bar 53 in the extended position can engage with the engaging groove 58B to prevent the movement of the cover plate 3 relative to the drum 2.

The bent, guide portions 59A and 59B serve to guide the slide bar 53 to the engaging grooves 59A and 59B, respectively, when the cover plate 3 is moved in the directions from the second to first positions and from the first to second positions, respectively. For example, when the cover plate 3 located between the first and second positions is moved to the second position, the slide bar 53 which is in the extended position by the action of the spring 54 is first brought into engagement with the guide portion 59B of the receiver plate 57B. As the cover plate 3 is further moved toward the second position, the slide bar 53 is pushed by the guide portion 59B and gradually displaced toward the retracted position against the biasing force of the spring 54. When the cover plate 3 is fully moved to the second position, the slide bar 53 is protruded by the action of the spring 54 and is brought into engagement with the groove 58B.

With continued reference to FIG. 2, designated generally as 6 is unlocking means secured to the frame 11 (FIG. 1) and operable to displace the slide bar 53 from the extended position to the retracted position when the cover plate 3 is in a predetermined position where the cover plate 3 is in the second, open position with the opening 23 of the drum 2 being oriented downward. Since the position of the cover plate 3 relative to the drum 2 can be changed while maintaining the cover plate 3 in the predetermined position, the unlocking means 6 can cause the slide bar 53 to be disengaged from the groove 58B when the cover plate 3 is in the second, open position and from the groove 58A when the cover plate 3 is in the first, closed position, as long as the cover plate 3 is maintained in the predetermined position.

The unlocking means 6 includes an air cylinder 61 whose operating rod 61*a* is provided with a pushing plate 62 at the tip end thereof. When the air cylinder 61 is actuated to extend the operating rod 61*a*, the pushing plate 62 is brought into engagement with the roller 55*a* of the pin 55 integrally provided on the slide bar 53. Upon further extension of the operating rod 61*a*, the slide bar 53 is displaced from the extended position as shown in the solid line in FIG. 3 to the retracted position as shown in the two-dotted line where the slide bar is disengaged from the groove 58A (or 58B). In the illustrated embodiment, a pair of such unlocking means 6 are provided. It is without saying that the unlocking means 6 corresponds in number to the number of the locking means 5.

Holding means 7 is supported on the frame 11 for holding the cover plate 3 in the above-mentioned, predetermined position. As best seen from FIG. 4, the holding means 7 in this illustrated embodiment includes an engaging arm 72 pivoted about a shaft 73 secured to the frame 11. The arm 72 has an extended portion 72*a* to which an operating rod 71*a* of an air cylinder 71 is connected. The arm 72 is rotatable about the shaft 73 between a disengaged position as shown by the solid line in FIG. 4 and an engaged position as shown by the two dotted line where the arm 72 is engaged by the frame member 52 formed on the cover plate 3. In the illustrated case, two sets of the holding means 7 are provided correspondingly to the two sets of lock means 5 and unlocking means 6.

Thus, when the operating rod 71*a* is in a retracted position, the arm 72 is in the disengaged position. Upon the actuation of the air cylinder 71, the operating rod 71 is displaced to an extended position, thereby causing the rotation of the arm 72 to the engaged position. When the arm 72 is maintained in engagement with the frame member 52, the cover plate 3 is held unmoved even when the drum 2 is rotated. Namely, by rotation of the drum clockwise in the state shown in FIG. 4 with the arm being maintained in the engaged position, the cover plate 3 is displaced relative to the drum 2 and is fully opened when the opening 23 of the drum 2 is oriented in a downward open position (as shown in FIG. 5).

In FIG. 5, designated as 8 is a belt conveyer disposed beneath the drum 2 to receive and convey dried cloths discharged therefrom through the opening 23.

The above-described cloth dryer operates as follows.

Wet cloths are charged through the opening 15 into the drum 2 while maintaining the cover plate 3 in the first, closed position by the locking operation of the lock means 5, namely by engagement of the slide bar 53 with the groove 58A of the receiver plate 57A, as shown in FIG. 2. The drive means 4 is then actuated to rotate the drum 2 while operating the air blower 80 and maintaining the cover plate in the closed position as shown in FIG. 6(*a*), so that the wet cloths are dried.

After the cloths have been dried, the drum 2 is stopped and angularly positioned so that the cover plate 3 is located in the predetermined position as shown in FIG. 2 where the unlocking means 6 is operable to unlock the lock means 5 and where the holding means 7 is operable to maintain the cover plate 3 in the predetermined position. The positioning of the drum 2 to locate the cover plate 3 in the predetermined position can be precisely effected by any known mechanism, for example by using a position sensor (not shown).

Then, the air cylinder 71 of the holding means 7 is actuated to displace the arm 72 to the engaged position so that the cover plate 2 is held by the holding means 7 in the predetermined position, as shown in FIG. 6(*b*). Further, the air cylinder 61 of the unlocking means 6 is actuated to displace the slide bar 53 to the retracted position against the biasing force of the spring 54 so that the the slide bar 53 is disengaged from the groove 58A.

Thereafter, the drum 2 is rotated clockwise through an angle so that the opening 23 of the drum is oriented downward as shown in FIG. 6(*c*). This rotation can cause the cover plate to displace, relative to the drum 2, to the open position. Thus, the cloths in the drum 2 fall by gravity on the conveyer 8.

In this case, during an initial stage of the rotation of the drum 2 from the state shown in FIG. 6(*b*) to the state shown in FIG. 6(*c*), the roller 55*a* of the pin 55 is maintained in rolling contact with the pushing plate 62 of the operating rod 61*a*. Since the pushing plate 62 is bent as shown in FIG. 2, the slide bar 53 is gradually displaced toward the protruded position as the drum 2 rotates. After the start of the rotation of the drum 2, the air cylinder 61 is operated to return the operating rod 61*a* to the retracted position. As a result, the slide bar is displaced to the fully extended position by the action of the spring 54. As the drum 2 is further rotated, the slide bar 53 is brought into engagement with the guide portion 59B of the receiver plate 57B and is gradually displaced toward the retracted position. When the drum 2 is rotated to displace the cover plate 3 to the fully open position, the slide bar 53 is engaged by the groove 58B to lock the cover plate 3.

Thus, the dried cloths are spontaneously discharged from the drum 2 through the above operation. When the cloths are not easily discharged, the holding means 7 is operated to disengage the arm 72 from the cover plate 3 and the drum 2 is slightly rotated in both directions to facilitate and complete the discharge of the cloths therefrom. Since the cover plate 3 is locked by the engagement of the slide bar 53 with the groove 58B, such rocking movement of the drum 2 does not cause any trouble.

After the completion of the discharge of the cloths, the drum 2 is located in the position shown in FIG. 6(*c*). While holding the cover plate in the predetermined position as shown in FIG. 6(*c*) with the holding means 7, the unlocking means 6 is actuated to unlock the lock means 6 and the drum 2 is rotated counterclockwise to close the opening 23. Then, the cover plate 3 is locked and the holding means 7 is disengaged. New wet cloths are then charged in the drum 2 to carry out the next drying step.

The above operation can be performed manually or automatically. When a belt conveyer for feeding cloths to be dried to the drying chamber in the drum 2 is used, the whole operation can be carried out in a fully automatic mode. In an automatic operation, the drive means 4, the unlocking means 6, the holding means 7, conveyer 8 and the like devices are electrically connected to a controller and operated by commands from the controller in a manner well known per se to the ordinary skilled in the art.

What is claimed is:

1. A cloth dryer comprising:

a frame;

a cylindrical drum having a cylindrical wall and defining therewithin a drying chamber for cloths and rotatably supported by said frame about a central, horizontal axis thereof;

means for rotating said drum about said central axis;

an opening formed in said cylindrical wall of said drum for discharging the cloths from said drying chamber therethrough;

a cover plate supported on said drum and movable relative to said drum between first and second relative positions so that said opening is closed when said cover plate is positioned in said first relative position and is opened when said cover plate is positioned in said second relative position, whereby the cloths within said drying chamber are discharged by gravity therefrom through said opening when said drum is stopped with said opening in a downwardly oriented position and when said cover plate is located in said second relative position;

holding means supported on said frame for engaging and holding said cover plate in a predetermined position fixed with respect to said frame, whereby when said cover plate is held with said holding means in said predetermined position, said cover plate is movable between said first and second relative positions by rotation of said drum;

locking means for locking said cover plate in said closed position, said locking means comprising a latch member moveable relative to said cover plate between an extended position and a retracted position and latch receiving means for engaging and holding said latch member in said extended position, one of said latch member and said latch receiving means being mounted on said cover plate and the other of said latch member and said latch receiving means being mounted on said drum; and means disposed adjacent to said drum for blowing air into said drying chamber.

2. A cloth dryer as claimed in claim 1, wherein said drum has a multiplicity of through-holes.

3. A cloth dryer as claimed in claim 1, further comprising a belt conveyer disposed beneath said drum to receive and convey the cloths discharged therefrom.

4. A cloth dryer as claimed in claim 2, wherein said air blowing means is arranged to blow air into said drying chamber through said through-holes.

5. A cloth dryer as claimed in claim 1, further comprising an aperture formed in at least one of the opposite sides of said drum for charging cloths to be dried into said drying chamber.

6. A cloth dryer as claimed in claim 1, wherein said cover plate is slidable along the periphery in the direction perpendicular to the axis of said drum.

7. A cloth dryer as claimed in claim 1, wherein said latch member is a slide bar supported on said cover plate and movable parallel to said central axis of said drum between said extended position and said retracted position, and wherein said locking means further comprises biasing means operably connected to said slide bar for normally urging said slide bar toward said extended position, a first plate member having a first engaging groove and secured to said drum at a position so that said slide bar in said extended position is engaged by said first engaging groove when said cover plate is located in said first position, and a second plate member having a second engaging groove and secured to said drum at a position so that said slide bar in said extended position is engaged by said second engaging groove when said cover plate is located in said second position.

8. A cloth dryer as claimed in claim 1, further comprising unlocking means secured to said frame and operable to displace said latch member from said extended position to said retracted position when said cover plate is in said predetermined position.

9. A cloth dryer comprising:

a frame;

a cylindrical drum having a cylindrical wall, an end wall closing one end of the drum and an opening in the end of said drum opposite said one end for charging cloths to be dried into the drum, said cylindrical drum defining therewithin a drying chamber for cloths and being rotatably supported by said frame about a central, horizontal axis thereof;

means for rotating said drum about said central axis;

an opening formed in said cylindrical wall of said drum for discharging the cloths from said drying chamber therethrough;

a cover plate supported on said drum and movable relative to said drum between first and second relative positions so that said opening is closed when said cover plate is positioned in said first relative position and is opened when said cover plate is positioned in said second relative position, whereby the cloths within said drying chamber are discharged by gravity therefrom through said opening when said drum is stopped with said opening in a downwardly oriented position and when said cover plate is located in said second relative position; and means disposed adjacent to said drum for blowing air into said drying chamber.

10. A cloth dryer as claimed in claim 9 further comprising a belt conveyor disposed beneath said drum to receive and convey cloths discharged therefrom.

11. A cloth dryer as claimed in claim 1 wherein said latch member is a bolt slidably mounted on said cover plate and said latch receiving means is a bracket mounted on said drum.

12. A cloth dryer as claimed in claim 11 wherein said locking means additionally comprises a spring element for biasing said sliding bolt toward said extended position for engagement with said bracket member.

13. A cloth dryer as claimed in claim 7 wherein said holding means comprises an arm member pivotally mounted on said frame for pivoting motion between extended and retracted positions, arm receiving means on said cover plate for engagement by said pivotal arm member and a fluid operator for pivoting said arm into engagement with said arm receiving means to engage and hold said cover plate against rotation.

14. A cloth dryer as claimed in claim 8 wherein said latch member is a bolt slidably mounted on said cover plate and said latch receiving means is a bracket mounted on said drum.

15. A cloth dryer as claimed in claim 14 further comprising a pin fixed to said sliding bolt at a right-angle thereto and wherein said unlocking means comprises a fluid operated piston and engaging means carried by said piston for engaging said pin and pushing said pin and said bolt against the force of said spring member to said retracted position.

* * * * *

UNITED STATES PATENT AND TRADEMARK OFFICE

CERTIFICATE OF CORRECTION

PATENT NO. : 5,255,449

DATED : October 26, 1993

INVENTOR(S) : NAKAMURA et al

It is certified that error appears in the above-indentified patent and that said Letters Patent is hereby corrected as shown below:

Col. 2, line 52, delete "close" and insert --closed--.

Col. 3, line 6, delete "close" and insert --closed--;

line 22, delete "59A and 59B" and insert --58A and 58B--; and line 36, delete "protruded" insert --extruded--.

Col. 5, line 4, delete "the protruded" insert --its extended--.

Col. 8, line 5, delete "7" and insert --1--.

Signed and Sealed this

Twenty-sixth Day of July, 1994

*Attest:*

*Attesting Officer*

BRUCE LEHMAN

*Commissioner of Patents and Trademarks*